US010981395B2

(12) United States Patent
Maeda et al.

(10) Patent No.: US 10,981,395 B2
(45) Date of Patent: Apr. 20, 2021

(54) PRINTER

(71) Applicant: SATO HOLDINGS KABUSHIKI KAISHA, Tokyo (JP)

(72) Inventors: Hideyuki Maeda, Tokyo (JP); Takayoshi Jinnouchi, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/606,825

(22) PCT Filed: Sep. 25, 2018

(86) PCT No.: PCT/JP2018/035515
§ 371 (c)(1),
(2) Date: Oct. 21, 2019

(87) PCT Pub. No.: WO2019/065654
PCT Pub. Date: Apr. 4, 2019

(65) Prior Publication Data

US 2020/0130365 A1 Apr. 30, 2020

(30) Foreign Application Priority Data

Sep. 26, 2017 (JP) ..... JP2017-185378

(51) Int. Cl.
*B41J 35/28* (2006.01)
*B41J 2/325* (2006.01)
(Continued)

(52) U.S. Cl.
CPC ..... *B41J 2/325* (2013.01); *B41J 17/24* (2013.01); *B41J 35/28* (2013.01); *B41J 3/36* (2013.01);
(Continued)

(58) Field of Classification Search
CPC ..... B41J 2/325; B41J 17/24; B41J 2202/30; B41J 2202/31; B41J 3/36; B41J 35/28; B41J 35/08
See application file for complete search history.

(56) References Cited

U.S. PATENT DOCUMENTS 5,385,416 A * 1/1995 Maekawa ..... B41J 17/36 400/208
5,653,542 A 8/1997 Sugimoto et al.
(Continued)

FOREIGN PATENT DOCUMENTS

EP 1 293 352 A1 3/2003
EP 2 284 014 A1 2/2011
(Continued)

OTHER PUBLICATIONS

USPTO Notice of Allowance, U.S. Appl. No. 16/605,840, dated Sep. 22, 2020, 8 pages.
(Continued)

*Primary Examiner* — Yaovi M Ameh
(74) *Attorney, Agent, or Firm* — Foley & Lardner LLP

(57) ABSTRACT

A printer includes a printing portion configured to print on a print medium, a ribbon supply shaft configured to hold an ink ribbon to be supplied to the printing portion, and a ribbon roll up shaft configured to roll up the used ink ribbon, wherein the ribbon supply shaft is provided movably between a ribbon supply position where the ink ribbon is supplied to the printing portion, and a ribbon replacement position where the ribbon supply shaft is attachable to and detachable from the printer, and rotated in the direction in which the ink ribbon is rolled up in the middle of moving from the ribbon replacement position to the ribbon supply position.

20 Claims, 8 Drawing Sheets

(51) Int. Cl.
*B41J 17/24* (2006.01)
*B41J 35/08* (2006.01)
*B41J 3/36* (2006.01)

(52) U.S. Cl.
CPC ..... *B41J 35/08* (2013.01); *B41J 2202/30* (2013.01); *B41J 2202/31* (2013.01)

(56) References Cited

U.S. PATENT DOCUMENTS

| | | | | |
|---|---|---|---|---|
| 6,215,508 | B1 | 4/2001 | Bryan et al. | |
| 2003/0047635 | A1 | 3/2003 | Hiraoka et al. | |
| 2005/0281602 | A1* | 12/2005 | Tu | B41J 17/32 400/208 |
| 2007/0212148 | A1 | 9/2007 | Numata et al. | |
| 2008/0193184 | A1 | 8/2008 | Daisuke | |
| 2010/0321458 | A1 | 12/2010 | Takeda | |
| 2011/0050832 | A1 | 3/2011 | Aihara et al. | |
| 2011/0058878 | A1* | 3/2011 | Maeda | B41J 29/02 400/242 |
| 2012/0057917 | A1 | 3/2012 | Van Britsom et al. | |
| 2015/0145941 | A1 | 5/2015 | Gao et al. | |
| 2015/0165797 | A1 | 6/2015 | Chari et al. | |
| 2015/0165802 | A1 | 6/2015 | Wong et al. | |
| 2016/0325568 | A1 | 11/2016 | Onodera | |
| 2020/0047518 | A1 | 2/2020 | Kakui et al. | |

FOREIGN PATENT DOCUMENTS

| | | | |
|---|---|---|---|
| JP | 61-128052 | U | 8/1986 |
| JP | 05-162405 | A | 6/1993 |
| JP | 07-314866 | A | 12/1995 |
| JP | 2002-241005 | A | 8/2002 |
| JP | 2003-80783 | A | 3/2003 |
| JP | 2004-142113 | A | 5/2004 |
| JP | 2007-230157 | A | 9/2007 |
| JP | 2009-179010 | A | 8/2009 |
| JP | 2009-286000 | A | 12/2009 |
| JP | 2014-046606 | A | 3/2014 |
| JP | 2015-000532 | A | 1/2015 |
| JP | 2015-096336 | A | 5/2015 |
| JP | 2017-503684 | A | 2/2017 |

OTHER PUBLICATIONS

U.S. Appl. No. 16/607,130, filed Oct. 22, 2019, Shioya et al.
USPTO Office Action, U.S. Appl. No. 16/605,840, dated Jun. 22, 2020, 9 pages.
Extended European Search Report, Application No. 18863074.3, dated Oct. 29, 2020, 9 pages.
USPTO Office Action, U.S. Appl. No. 16/607,130, dated Jan. 13, 2021, 12 pages.

* cited by examiner

PRINTER

TECHNICAL FIELD

The present invention relates to a printer.

BACKGROUND ART

JP2009-179010A discloses a thermal transfer printer including a ribbon supply shaft that holds an ink ribbon to be supplied to a printing portion in a roll form, and a ribbon roll up shaft that rolls up the used ink ribbon, wherein the ink ribbon is heated and inks of the ink ribbon are transferred to a print medium, so that printing is performed.

SUMMARY OF INVENTION

In the above printer, at the time of replacing the ink ribbon, there is a need for rotating the ribbon supply shaft or the ribbon roll up shaft to eliminate looseness of the ink ribbon. Therefore, a task of replacing the ink ribbon is troublesome.

The present invention is achieved in consideration with such a technical problem, and an object of the present invention is to efficiently perform a task of replacing an ink ribbon.

According to an aspect of the present invention, a printer includes a printing portion configured to print on a print medium, a ribbon supply shaft configured to hold an ink ribbon to be supplied to the printing portion, and a ribbon roll up shaft configured to roll up the used ink ribbon, wherein the ribbon supply shaft is provided movably between a ribbon supply position where the ink ribbon is supplied to the printing portion, and a ribbon replacement position where the ribbon supply shaft is attachable to and detachable from the printer, and rotated in the direction in which the ink ribbon is rolled up in the middle of moving from the ribbon replacement position to the ribbon supply position is provided.

With this aspect, when the ribbon supply shaft is brought from the ribbon replacement position to the ribbon supply position, the ribbon supply shaft is automatically rotated and the ink ribbon is rolled up. Therefore, there is no need for performing a task of rotating the ribbon supply shaft or the ribbon roll up shaft in order to eliminate looseness of the ink ribbon. Thus, it is possible to efficiently perform a task of replacing the ink ribbon.

DESCRIPTION OF EMBODIMENTS

Hereinafter, a printer 100 according to an embodiment of the present invention will be described with reference to the attached drawings.

The printer 100 is a thermal transfer printer in which an ink ribbon R is heated and inks of the ink ribbon R are transferred to a print medium M, so that printing is performed. The print medium M is, for example, a label continuous body in which plural labels are continuously temporarily attached to a band-shaped liner sheet.

Figure 1:
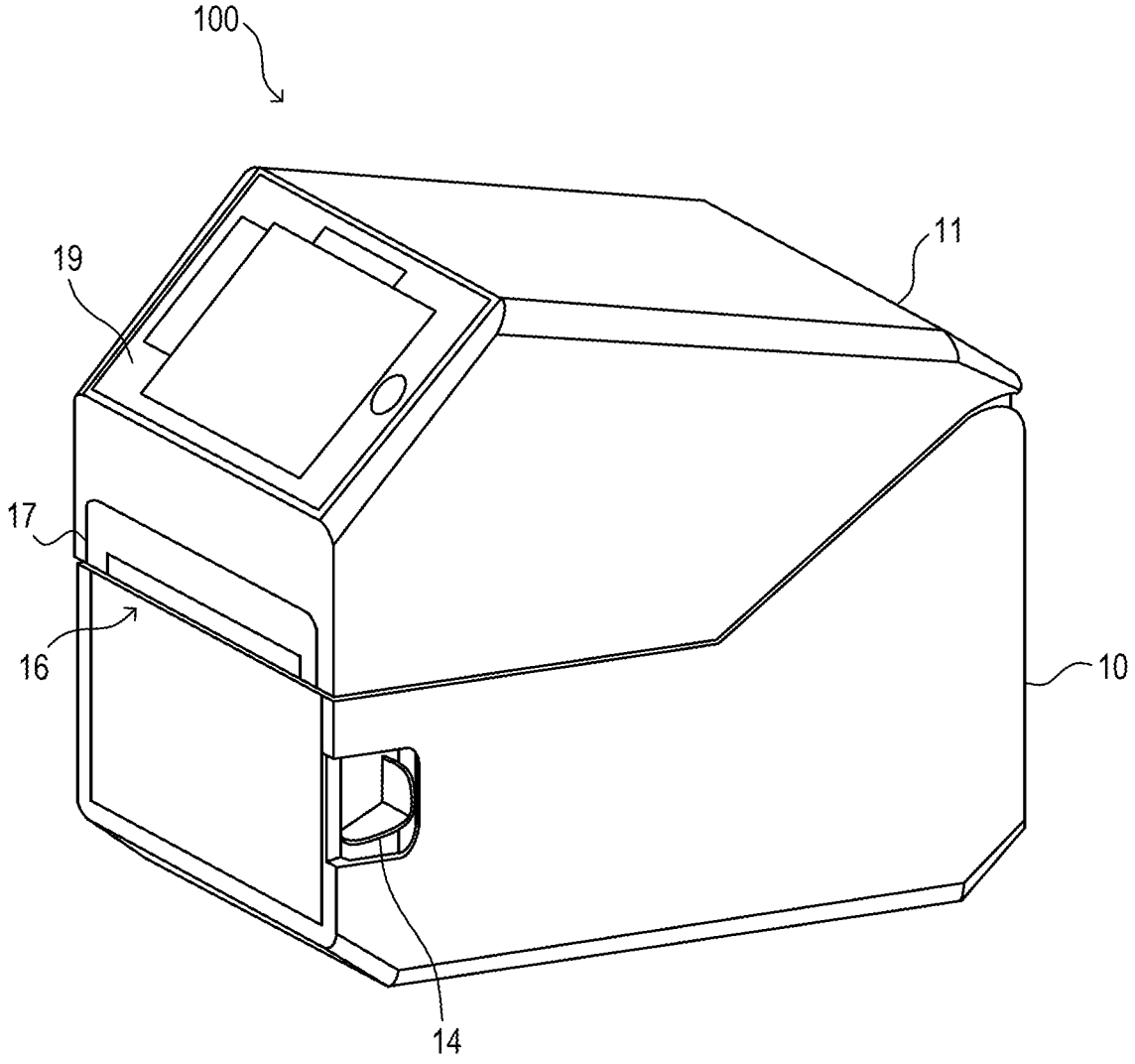
FIG. 1 is a perspective view of a printer according to an embodiment of the present invention.
Figure 2:
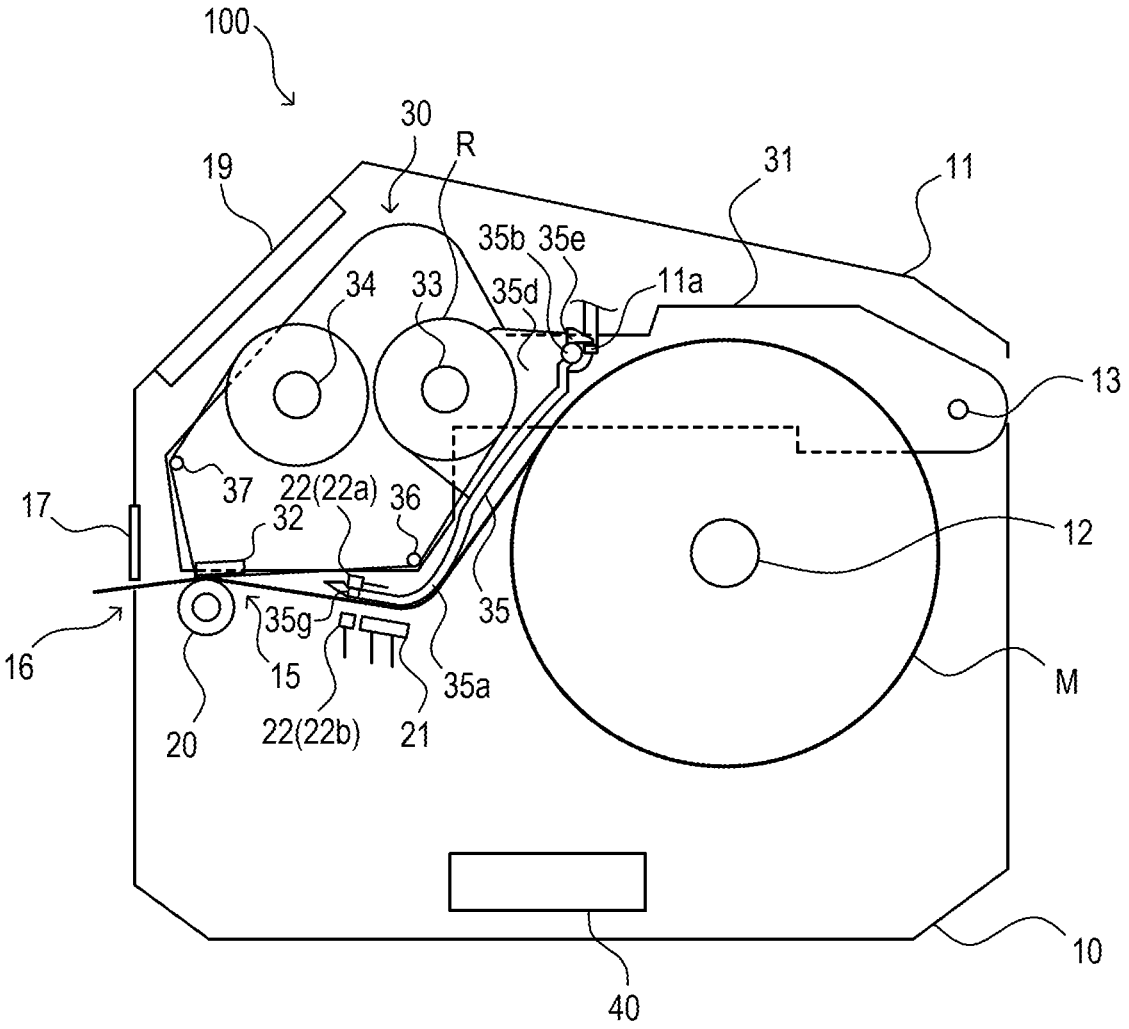
FIG. 2 is a schematic configuration view of the printer according to the embodiment of the present invention.

As shown in FIGS. 1 and 2, the printer 100 includes a casing 10, and a cover 11 that covers an opening portion of the casing 10.

As shown in FIG. 2, the print medium M is held on a medium supply shaft 12 in a state where the print medium M is wound in a roll form. Note that as the print medium M, a linerless label or a fanfold medium can also be used.

A one-end side end portion of the cover 11 is supported by a support shaft 13 provided in the casing 10 so that the cover is swingable. By swinging with the support shaft 13 as a supporting point, it is possible to switch the cover 11 between an open state where the opening portion of the casing 10 is opened (see FIG. 4) and a close state where the opening portion is closed (see FIG. 2).

A lock mechanism (not shown) that maintains the close state of the cover 11 is provided in the casing 10. The lock mechanism is cancelled by operating a lever 14 shown in FIG. 1.

Between an other-end side end portion of the cover 11 and the casing 10, an outlet port 16 that discharges the print medium M to which printing is already performed by a printing portion 15 shown in FIG. 2 from the printer 100 is formed.

A cutter 17 facing the outlet port 16 is attached to the cover 11 of the present embodiment. Thereby, it is possible to cut the printed print medium M discharged from the outlet port 16. Note that it is possible to attach various other units to the cover 11 instead of the cutter 17.

An operation unit 19 for operating the printer 100 is also provided in the cover 11. The operation unit 19 has various operation buttons, a display, a near-field communication module, LEDs, etc. The display may be a touch panel.

Inside the printer 100, a printing unit 30 for performing printing to the print medium M, a controller 40 that controls actions of the printer 100, etc. are accommodated.

The printing unit 30 includes a main body portion 31 whose one end side is supported by the support shaft 13 so that the main body portion 31 is swingable, and a thermal head 32 attached to the main body portion 31.

The thermal head 32 constitutes the printing portion 15 that performs printing to the print medium M together with a platen roller 20 provided on the casing 10 side.

The printing unit 30 also includes a ribbon supply shaft 33 that holds the ink ribbon R to be supplied to the printing portion 15 in a roll form, a ribbon roll up shaft 34 that rolls up the used ink ribbon R, a partition member 35 that partitions the ink ribbon R and the print medium M, a guide shaft 36 that defines a feed passage of the ink ribbon R from the ribbon supply shaft 33 to the printing portion 15, and a guide shaft 37 that defines a feed passage of the ink ribbon R from the printing portion 15 to the ribbon roll up shaft 34. The ribbon supply shaft 33 is detachably attached to the partition member 35. Note that the ink ribbon R of the present embodiment is an outside wound ink ribbon in which a surface where inks are applied are on the outside.

The print medium M is supplied from the medium supply shaft 12 to the printing portion 15, and nipped between the thermal head 32 and the platen roller 20 together with the ink ribbon R.

When electricity is distributed through to a heating element of the thermal head 32 in a state where the print medium M and the ink ribbon R are nipped between the thermal head 32 and the platen roller 20, the inks of the ink ribbon R are transferred to the print medium M by heat of the heating element, so that printing is performed to the print medium M.

When the platen roller 20 is rotated forward by a platen drive motor (not shown), the print medium M and the ink ribbon R are fed to the downstream side in the feed direction, and the print medium M is discharged to the outside of the printer 100 from the outlet port 16.

Figure 3:
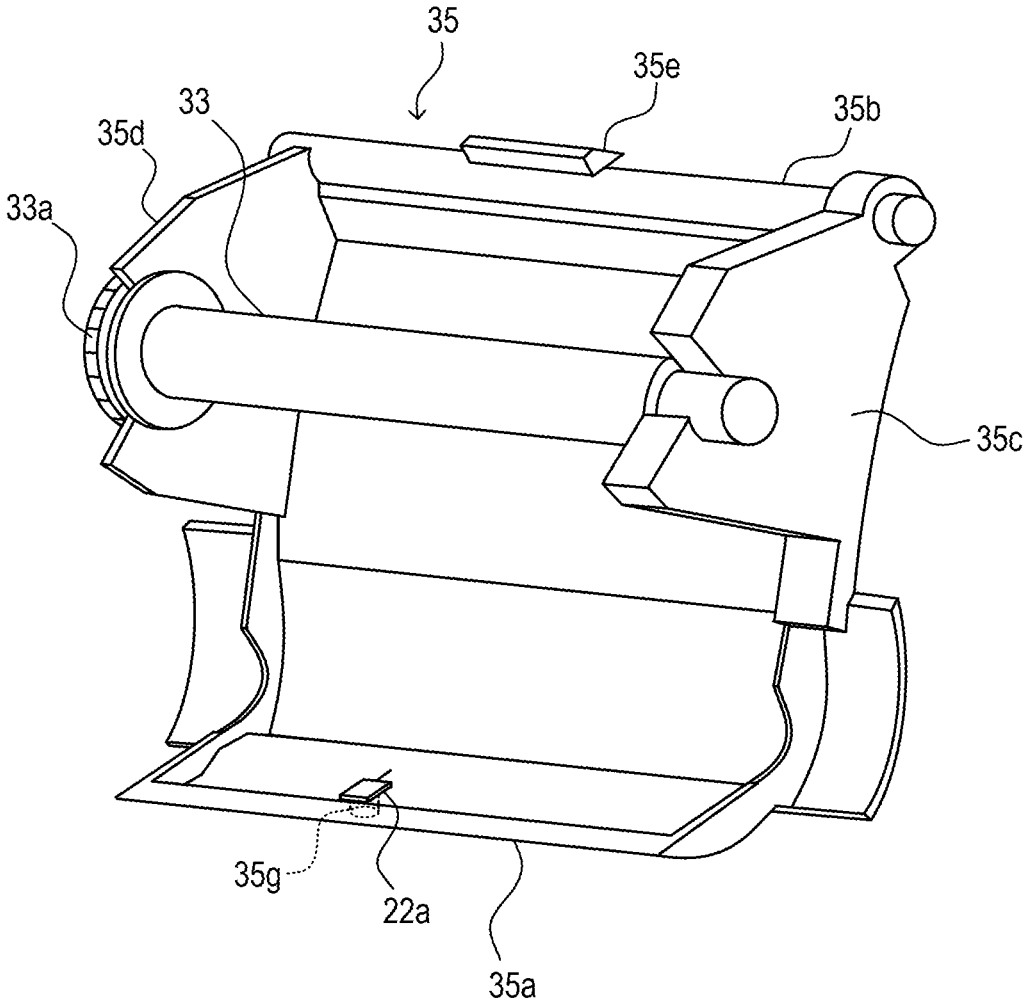
FIG. 3 is a perspective view of a partition member and a ribbon supply shaft.

As shown in FIG. 3, the partition member 35 has a base portion 35*a*, a shaft portion 35*b* provided on the one end side of the base portion 35*a*, support portions 35*c*, 35*d* that rotatably support the ribbon supply shaft 33 in parallel to the shaft portion 35*b*, and an engagement portion 35*e* formed in a center portion of the shaft portion 35*b*.

The partition member 35 is swingably supported on the main body portion 31 by the shaft portion 35*b*.

As shown in FIG. 2, the engagement portion 35*e* is configured to be engaged with an engaged portion 11*a* provided in the cover 11. When the partition member 35 is brought to a position (close position) where the engagement portion 35*e* is engaged with the engaged portion 11*a*, the ribbon supply shaft 33 is accommodated in the main body portion 31. Thereby, the ribbon supply shaft 33 is brought to a ribbon supply position where the ink ribbon R is supplied to the printing portion 15.

In such a way, by engaging the engagement portion 35*e* with the engaged portion 11*a*, the partition member 35 is maintained at the close position where the ribbon supply shaft 33 is placed at the ribbon supply position. The printing unit 30 and the cover 11 are combined with each other.

At the time of performing printing by the printer 100, the cover 11 is brought into the close state, and the engagement portion 35*e* of the partition member 35 is engaged with the engaged portion 11*a* of the cover 11.

Figure 4:
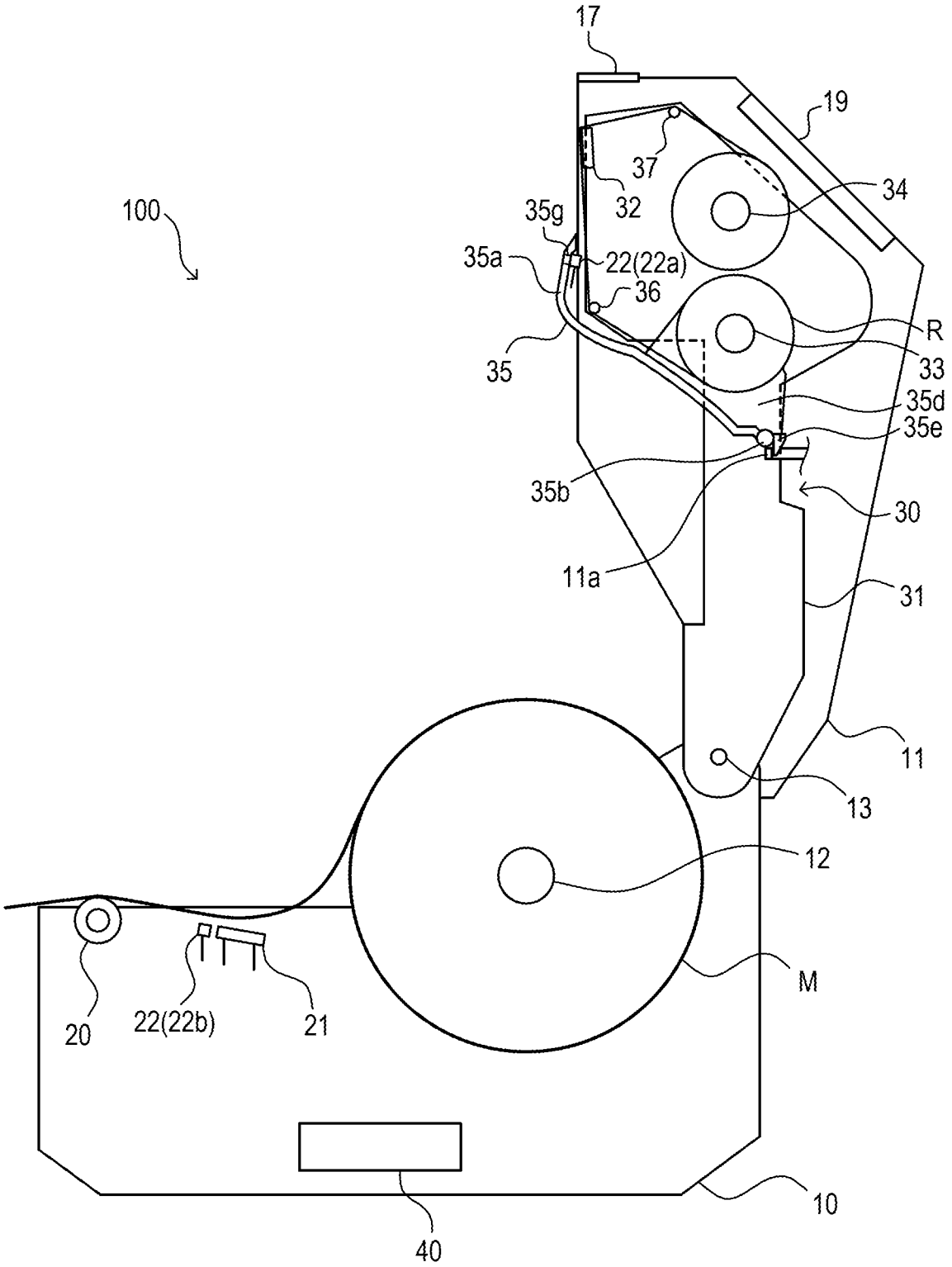
FIG. 4 is a view showing a state where a cover is opened.

Therefore, when the cover 11 is brought into the open state from the close state, the printing unit 30 is swung integrally with the cover 11, and as shown in FIG. 4, the opening portion of the casing 10 is opened.

Thereby, it is possible to perform settings of the print medium M to the printer 100 and maintenance of portions in the casing 10.

Figure 5:
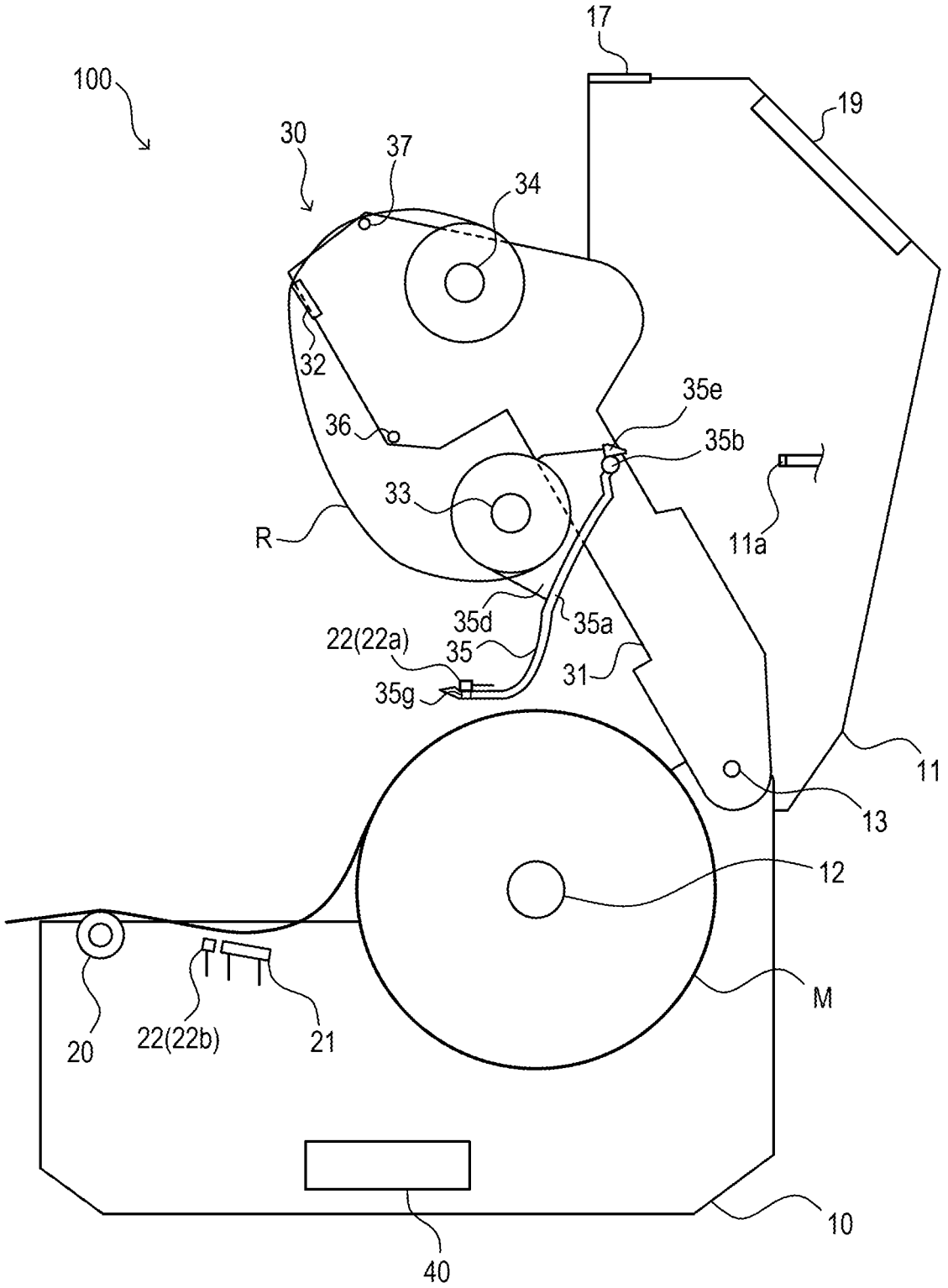
FIG. 5 is a view showing a state where the ribbon supply shaft is placed at a ribbon replacement position.

Further, when engagement between the engagement portion 35*e* and the engaged portion 11*a* is cancelled from the state shown in FIG. 4 and the partition member 35 is swung to the casing 10 side, the partition member 35 is brought to an open position shown in FIG. 5.

Following the state that the partition member 35 is brought to the open position, the ribbon supply shaft 33 and the roll-form ink ribbon R held by the ribbon supply shaft 33 are moved with respect to the ribbon roll up shaft 34, and exposed to the outlet port 16 of the print medium M. Note that the ribbon roll up shaft 34 is attached to the main body portion 31 and is not movable with respect to the printing unit 30.

Thereby, the ribbon supply shaft 33 is brought to a ribbon replacement position where the ribbon supply shaft 33 is attachable to and detachable from the printer 100, and it is possible to perform a task of replacing the ink ribbon R.

In such a way, in the present embodiment, the ribbon supply shaft 33 is movable with respect to the ribbon roll up shaft 34. At the time of replacing the ink ribbon R, it is possible to move the ribbon supply shaft 33 to the ribbon replacement position where the task can be easily performed.

The ribbon supply shaft 33 is exposed to the outlet port 16 side of the print medium M, that is, to the side of a position where a user performs tasks. Thereby, it is possible to improve workability more.

In a state where the ribbon supply shaft 33 is placed at the ribbon replacement position, as shown in FIG. 5, all the feed passages of the ink ribbon R from the ribbon supply shaft 33 to the ribbon roll up shaft 34 are exposed. Therefore, a task of putting the ink ribbon R from the ribbon supply shaft 33 to the ribbon roll up shaft 34 is more easily performed.

When the partition member 35 is swung to the casing 10 side with torque which is predetermined torque or more, the engagement portion 35*e* and the engaged portion 11*a* are elastically deformed and the engagement between the engagement portion 35*e* and the engaged portion 11*a* is cancelled.

Note that by cancelling the engagement between the engagement portion 35*e* and the engaged portion 11*a*, the printing unit 30 itself is swung to a predetermined position toward the casing 10 side. The predetermined position is a position where a swing regulating portion (not shown) provided in the vicinity of the support shaft 13 in the casing 10 and the main body portion 31 are abutted with each other.

When the printing unit 30 is swung to the casing 10 side with torque which is predetermined torque or more, the swing regulating portion is elastically deformed, the main body portion 31 goes over the swing regulating portion, and the positioning of the printing unit 30 by the swing regulating portion is cancelled.

As shown in FIG. 2, the base portion 35*a* of the partition member 35 extends to a position where the base portion 35*a* opposes a reflection sensor 21 provided in the casing 10. Thereby, a feed passage of the print medium M is formed between the reflection sensor 21 and the part of the partition member 35 opposing the reflection sensor 21.

The reflection sensor 21 is a sensor that detects eye marks which are preliminarily printed on a surface of the print medium M opposite to a printed surface at predetermined intervals. Thereby, it is possible to detect a position of the print medium M in the feed direction.

In the present embodiment, by the partition member 35 guiding the print medium M, the print medium M is stably fed within a fixed distance from the reflection sensor 21. Thereby, it is possible to improve detection precision of the reflection sensor 21.

Note that when the printer 100 is brought into a printable state, that is, into the state shown in FIG. 2, the partition member 35 is automatically brought into a state of guiding the print medium M.

In such a way, since the print medium M is guided by the partition member 35, there is no need for separately providing a guide member for feeding the print medium M within a fixed distance from the reflection sensor 21, and a task of inserting the print medium M into the guide member is also not required.

The printer 100 also includes a light transmission sensor 22 that detects the position of the print medium M in the feed direction.

The light transmission sensor 22 is a sensor having a light emitting unit 22*a* which serves as a light emitting portion that emits predetermined light, and a light receiving unit 22*b* which serves as a light receiving portion that receives the light emitted from the light emitting unit 22*a* and outputs an electric signal corresponding to intensity of the received light.

For example, in a case where the print medium M is a label continuous body in which plural labels are continuously temporarily attached to a band-shaped liner sheet at predetermined intervals, there is an only-liner part between two adjacent labels.

Between the label part and the only-liner part, a transmission amount of the light emitted from the light emitting unit 22*a* is different, and hence the intensity of the light received by the light receiving unit 22*b* is changed. Thereby, the light transmission sensor 22 can detect the position of the print medium M in the feed direction.

In the present embodiment, as shown in FIGS. 2 and 3, the light emitting unit 22*a* is provided on the opposite side of the feed passage of the print medium M in the base portion 35*a*, that is, on the upper surface side of the base portion 35*a*. In the base portion 35*a*, a through hole 35*g* through which the light emitted from the light emitting unit 22*a* passes is formed. Meanwhile, as shown in FIG. 2, the light receiving unit 22*b* is provided on the casing 10 side across the feed passage.

As described above, the task of setting the print medium M in the printer 100 is performed in a state where the printing unit 30 is placed at a non-printing position and the opening portion of the casing 10 is opened.

That is, in the present embodiment, it is possible to set the print medium M in the printer 100 in a state where a portion between the light emitting unit 22*a* and the light receiving unit 22*b* is widely opened. Thus, it is possible to easily perform the task of setting the print medium M in the printer 100. Note that the position of the light emitting unit 22*a* may be exchanged with the position of the light receiving unit 22*b*.

The printer 100 activates any of the reflection sensor 21 and the light transmission sensor 22 in accordance with a type of a print medium M to be used, and detects the position of the print medium M in the feed direction.

For example, in a case where a print medium M provided with no eye marks is used, the printer 100 detects the position of the print medium M by the light transmission sensor 22.

The controller 40 is constituted by a microprocessor, storage devices such as a ROM and a RAM, an input/output interface, buses that connect these members, etc. Print data from external computers, signals from the reflection sensor 21, signals from the light transmission sensor 22, etc. are inputted to the controller 40 via the input/output interface.

The controller 40 executes a print control program stored in the storage device by the microprocessor, and controls electricity distribution to the heating element of the thermal head 32, electricity distribution to the platen drive motor, etc.

Successively, the printing unit 30 will be described in detail with reference to FIGS. 6 and 7 mainly. Note that the ink ribbon R is omitted from FIGS. 6 and 7 for easy understanding.

Figure 6:
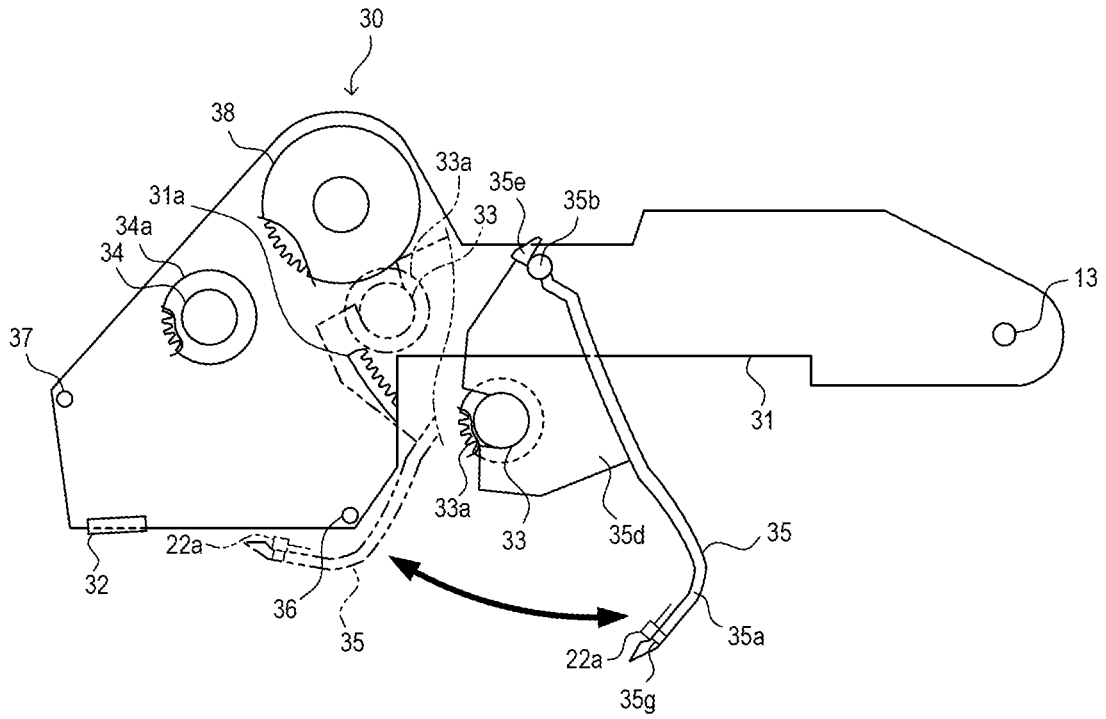
FIG. 6 is a view for explaining a printing unit.

As shown in FIGS. 3 and 6, the ribbon supply shaft 33 has a gear 33*a* formed on the one end side.

As shown in FIG. 6, the printing unit 30 includes a gear 38 to mesh with the gear 33*a* in a state where the ribbon supply shaft 33 is placed at the ribbon supply position (double-chain line). The ribbon supply shaft 33 is driven by a supply shaft drive motor (not shown) via the gear 38.

As shown in FIG. 6, the ribbon roll up shaft 34 has a gear 34*a* formed on the one end side. The ribbon roll up shaft 34 is driven by a roll up shaft drive motor (not shown) via a gear (not shown).

Rotation of the ribbon supply shaft 33 and the ribbon roll up shaft 34 is controlled by the controller 40 in synchronization with rotation of the platen roller 20. Note that the ribbon supply shaft 33 and the ribbon roll up shaft 34 may be driven by one drive motor.

As described above, the printing unit 30 includes the partition member 35 whose one end side is supported on the main body portion 31 by the shaft portion 35*b* so that the partition member is swingable. The ribbon supply shaft 33 is attached to the partition member 35.

Thereby, as shown in FIG. 6, when the partition member 35 is brought to the close position (double-chain line), the ribbon supply shaft 33 is brought to the ribbon supply position (double-chain line) where the ink ribbon R is supplied to the printing portion 15. When the partition member is brought to the open position (solid line), the ribbon supply shaft 33 is brought to the ribbon replacement position (solid line) where the ribbon supply shaft is attachable to and detachable from the printer 100. Note that a lock mechanism (not shown) for holding the ribbon supply shaft 33 is provided in the partition member 35. By cancelling lock by the lock mechanism at the ribbon replacement position, the ribbon supply shaft 33 can be detached from the printer 100.

Figure 7:
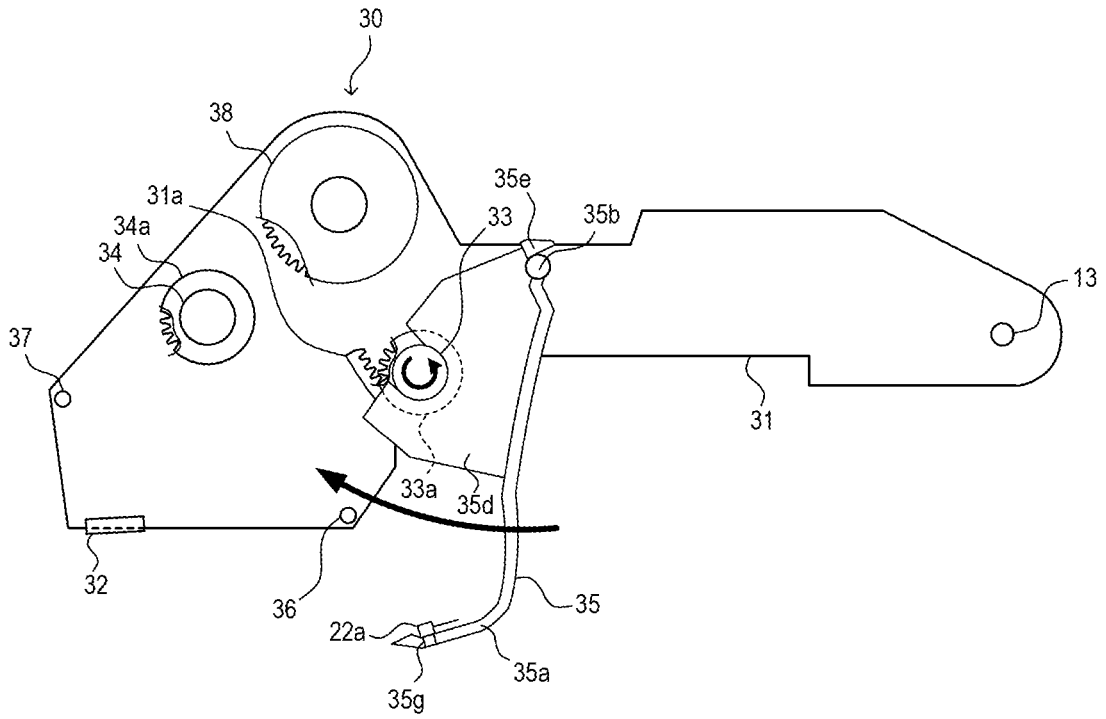
FIG. 7 is a view for explaining a situation where the partition member is brought from an open position to a close position.

As shown in FIGS. 6 and 7, a rack 31*a* is provided in the main body portion 31.

As shown in FIG. 7, the rack 31*a* meshes with the gear 33*a* in the middle of the partition member 35 moving from the open position to the close position, and rotates the ribbon supply shaft 33 in the direction in which the ink ribbon R is rolled up.

In a case where the ink ribbon R is replaced, etc., as shown in FIG. 5, there is sometimes a case where the ink ribbon R is loosened. In a case where the ink ribbon R is loosened, there is a need for rotating the ribbon supply shaft 33 or the ribbon roll up shaft 34 to remove looseness of the ink ribbon R.

Meanwhile, in the present embodiment, when the partition member 35 is brought from the open position to the close position and the ribbon supply shaft 33 is brought from the ribbon replacement position to the ribbon supply position, the ribbon supply shaft 33 is automatically rotated in the direction in which the ink ribbon R is rolled up, so that the ink ribbon R is rolled up and the looseness of the ink ribbon R is removed.

According to this, there is no need for performing a task of rotating the ribbon supply shaft 33 or the ribbon roll up shaft 34 in order to eliminate the looseness of the ink ribbon R. Thus, it is possible to efficiently perform the task of replacing the ink ribbon R. Since the looseness of the ink ribbon R is eliminated, it is possible to prevent occurrence of printing failure due to the looseness of the ink ribbon R.

Note that meshing between the gear 33*a* and the rack 31*a* is cancelled immediately before the ribbon supply shaft 33 is brought to the ribbon supply position. That is, in a state where the ribbon supply shaft 33 is placed at the ribbon supply position, the rack 31*a* does not mesh with the gear 33*a*. Therefore, the rack 31*a* does not inhibit rotation of the ribbon supply shaft 33 at the time of printing.

Immediately after the meshing between the gear 33*a* and the rack 31*a* is cancelled, the gear 33*a* meshes with the gear 38. Thus, it is possible to suppress that the ribbon supply shaft 33 is rotated in the direction in which the ink ribbon R is supplied to the printing portion 15 within a period from cancellation of the meshing between the gear 33*a* and the rack 31*a* to meshing between the gear 33*a* and the gear 38.

As described above, the printer 100 of the present embodiment includes the printing portion 15 that performs printing to the print medium M, the ribbon supply shaft 33 that holds the ink ribbon R to be supplied to the printing portion 15, and the ribbon roll up shaft 34 that rolls up the used ink ribbon R. The ribbon supply shaft 33 is provided movably between the ribbon supply position where the ink ribbon R is supplied to the printing portion 15 and the ribbon replacement position where the ribbon supply shaft 33 is attachable to and detachable from the printer 100, and rotated in the direction in which the ink ribbon R is rolled up in the middle of moving from the ribbon replacement position to the ribbon supply position.

Specifically, the gear 33*a* is provided in the ribbon supply shaft 33, and the printer 100 includes the rack 31*a* to mesh with the gear 33*a* in the middle of the ribbon supply shaft 33 moving from the ribbon replacement position to the ribbon supply position.

According to this, when the ribbon supply shaft 33 is brought from the ribbon replacement position to the ribbon supply position, the ribbon supply shaft 33 is automatically rotated, so that the ink ribbon R is rolled up. Therefore, there is no need for performing the task of rotating the ribbon supply shaft 33 or the ribbon roll up shaft 34 in order to eliminate the looseness of the ink ribbon R. Thus, it is possible to efficiently perform the task of replacing the ink ribbon R.

The rack 31*a* does not mesh with the gear 33*a* in a state where the ribbon supply shaft 33 is placed at the ribbon supply position.

Therefore, the rack 31*a* does not inhibit the rotation of the ribbon supply shaft 33 at the time of printing.

The printer 100 includes the swingably provided partition member 35 that partitions the ink ribbon R and the print medium M. The ribbon supply shaft 33 is attached to the partition member 35.

According to this, at the time of replacing the ink ribbon R, it is possible to move the ribbon supply shaft 33 to the ribbon replacement position where the task can be easily performed.

The printer 100 includes the swingably provided printing unit 30 having the thermal head 32 that constitutes the printing portion 15, the ribbon supply shaft 33, the ribbon roll up shaft 34, and the partition member 35 are provided in the printing unit 30, and the ribbon roll up shaft 34 is not movable with respect to the printing unit 30.

According to this, the ribbon roll up shaft 34 is not moved with respect to the printing unit 30. Thus, when the ribbon supply shaft 33 is brought to the ribbon supply position and the ink ribbon R is rolled up, it is possible to efficiently eliminate the looseness of the ink ribbon R.

The printer 100 includes the casing 10 and the cover 11 that covers the opening portion of the casing 10, and the partition member 35 has the engagement portion 35*e* to be engaged with the engaged portion 11*a* provided in the cover 11. When the engagement portion 35*e* and the engaged portion 11*a* are engaged with each other, the partition member 35 is maintained at the close position where the ribbon supply shaft 33 is placed at the ribbon supply position, and the printing unit 30 and the cover 11 are combined with each other.

According to this, when the cover 11 is brought from the close state to the open state, the printing unit 30 is swung integrally with the cover 11. Therefore, at the time of performing settings of the print medium M and maintenance of portions in the casing 10, there is no need for individually opening the cover 11 and the printing unit 30, and it is possible to efficiently perform the task.

The embodiment of the present invention is described above. However, the above embodiment only shows one of application examples of the present invention and there is no intention to limit the technical scope of the present invention to the specific configurations of the embodiment described above.

Figure 8:
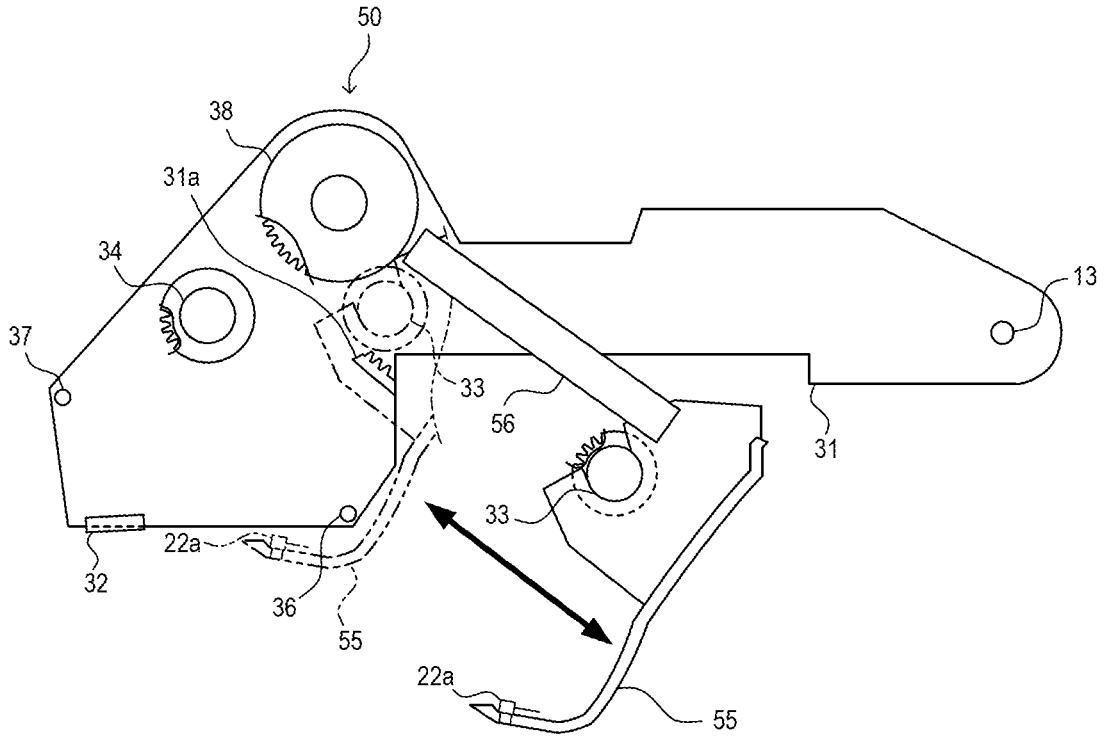
FIG. 8 is a view for explaining a modified example of the printing unit.

For example, in the above embodiment, by swingably providing the partition member 35 in the printing unit 30, the ribbon supply shaft 33 attached to the partition member 35 is moved with respect to the ribbon roll up shaft 34. However, as in a printing unit 50 shown in FIG. 8, the ribbon supply shaft 33 may be moved by providing a slide mechanism 56 that lets a partition member 55 slide.

In the above embodiment, the printer 100 includes the cover 11. However, the printing unit 30 may function as a cover without providing the cover 11. In this case, an engaged portion to be engaged with the engagement portion 35*e* of the partition member 35 is provided in the main body portion 31 of the printing unit 30, etc.

The present application makes a priority claim based on Japanese Patent Application No. 2017-185378 filed in the Japan Patent Office on Sep. 26, 2017, and the entire disclosure of this application is incorporated herein by reference.

The invention claimed is:

1. A printer, comprising:

a printing portion configured to print on a print medium;

a ribbon supply shaft configured to hold an ink ribbon to be supplied to the printing portion; and a ribbon roll up shaft configured to roll up the ink ribbon, wherein the ribbon supply shaft is provided movably between a ribbon supply position where the ink ribbon is supplied to the printing portion and a ribbon replacement position where the ribbon supply shaft is attachable to and detachable from the printer, such that as the ribbon supply shaft moves from the ribbon replacement position to the ribbon supply position, the ribbon supply shaft rotates about a longitudinal axis of the ribbon supply shaft in a direction in which the ink ribbon is rolled up on the ribbon supply shaft, wherein the ribbon supply shaft is movably provided, relative to the ribbon roll up shaft, between the ribbon supply position and the ribbon replacement position.

2. The printer according to claim 1, wherein the ribbon supply shaft comprises a gear, and the printer comprises a rack to mesh with the gear as the ribbon supply shaft moves from the ribbon replacement position to the ribbon supply position.

3. The printer according to claim 2, wherein in a state where the ribbon supply shaft is at the ribbon supply position, the rack does not mesh with the gear.

4. The printer according to claim 1, comprising:

a partition member provided swingably, the partition member partitioning the ink ribbon and the print medium, wherein the ribbon supply shaft is attached to the partition member.

5. The printer according to claim 4, comprising:

a printing unit provided swingably, the printing unit having a thermal head that constitutes the printing portion, wherein the ribbon supply shaft, the ribbon roll up shaft, and the partition member are provided in the printing unit, and the ribbon roll up shaft is not movable with respect to the printing unit.

6. The printer according to claim 5, comprising:

a casing; and a cover configured to cover an opening portion of the casing, wherein the partition member has an engagement portion to be engaged with an engaged portion provided in the cover, and when the engagement portion and the engaged portion are engaged with each other, the partition member is maintained at a position where the ribbon supply shaft is placed at the ribbon supply position, and the printing unit and the cover are combined with each other.

7. The printer according to claim 2, comprising:

a partition member provided swingably, the partition member partitioning the ink ribbon and the print medium, wherein the ribbon supply shaft is attached to the partition member.

8. The printer according to claim 7, comprising:

a printing unit provided swingably, the printing unit having a thermal head that constitutes the printing portion, wherein the ribbon supply shaft, the ribbon roll up shaft, and the partition member are provided in the printing unit, and the ribbon roll up shaft is not movable with respect to the printing unit.

9. The printer according to claim 8, comprising:

a casing; and a cover configured to cover an opening portion of the casing, wherein the partition member has an engagement portion to be engaged with an engaged portion provided in the cover, and when the engagement portion and the engaged portion are engaged with each other, the partition member is maintained at a position where the ribbon supply shaft is placed at the ribbon supply position, and the printing unit and the cover are combined with each other.

10. The printer according to claim 3, comprising:

a partition member provided swingably, the partition member partitioning the ink ribbon and the print medium, wherein the ribbon supply shaft is attached to the partition member.

11. The printer according to claim 10, comprising:

a printing unit provided swingably, the printing unit having a thermal head that constitutes the printing portion, wherein the ribbon supply shaft, the ribbon roll up shaft, and the partition member are provided in the printing unit, and the ribbon roll up shaft is not movable with respect to the printing unit.

12. The printer according to claim 11, comprising:

a casing; and a cover configured to cover an opening portion of the casing, wherein the partition member has an engagement portion to be engaged with an engaged portion provided in the cover, and when the engagement portion and the engaged portion are engaged with each other, the partition member is maintained at a position where the ribbon supply shaft is placed at the ribbon supply position, and the printing unit and the cover are combined with each other.

13. The printer according to claim 1, wherein the ribbon supply shaft is closer to the ribbon roll up shaft in the ribbon supply position than in the ribbon replacement position.

14. The printer according to claim 1, further comprising:

a printing unit provided swingably, the printing unit having a thermal head, wherein the ribbon supply shaft and the ribbon roll up shaft are provided in the printing unit.

15. A printer, comprising:

a printing portion configured to print on a print medium;

a ribbon supply shaft configured to hold an ink ribbon to be supplied to the printing portion; and a ribbon roll up shaft configured to roll up the ink ribbon, wherein the ribbon supply shaft is provided movably between a ribbon supply position where the ink ribbon is supplied to the printing portion and a ribbon replacement position where the ribbon supply shaft is attachable to and detachable from the printer, such that as the ribbon supply shaft moves from the ribbon replacement position to the ribbon supply position, the ribbon supply shaft rotates about a longitudinal axis of the ribbon supply shaft in a direction in which the ink ribbon is rolled up on the ribbon supply shaft, wherein the ribbon supply shaft is closer to the ribbon roll up shaft in the ribbon supply position than in the ribbon replacement position.

16. The printer according to claim 15, wherein the ribbon supply shaft comprises a gear, and the printer comprises a rack to mesh with the gear as the ribbon supply shaft moves from the ribbon replacement position to the ribbon supply position.

17. The printer according to claim 16, wherein in a state where the ribbon supply shaft is at the ribbon supply position, the rack does not mesh with the gear.

18. The printer according to claim 15, comprising:

a partition member provided swingably, the partition member partitioning the ink ribbon and the print medium, wherein the ribbon supply shaft is attached to the partition member.

19. The printer according to claim 18, comprising:

a printing unit provided swingably, the printing unit having a thermal head that constitutes the printing portion, wherein the ribbon supply shaft, the ribbon roll up shaft, and the partition member are provided in the printing unit, and the ribbon roll up shaft is not movable with respect to the printing unit.

20. The printer according to claim 15, further comprising:

a printing unit provided swingably, the printing unit having a thermal head, wherein the ribbon supply shaft and the ribbon roll up shaft are provided in the printing unit.

* * * * *